US005170974A

United States Patent [19]

Ruggiero

[11] Patent Number: 5,170,974

[45] Date of Patent: Dec. 15, 1992

[54] SHOWER CURTAIN SUPPORTS

[76] Inventor: Anthony J. Ruggiero, 7724 Summerdale Ave., Philadelphia, Pa. 19111

[21] Appl. No.: 751,100

[22] Filed: Aug. 28, 1991

[51] Int. Cl.[5] ..... A47H 1/14

[52] U.S. Cl. ..... 248/251; 160/330; 4/610

[58] Field of Search ..... 248/251; 160/330, DIG. 6; 211/105.1; 4/610

[56] References Cited

U.S. PATENT DOCUMENTS

| | | | |
|---|---|---|---|
| 2,481,397 | 9/1949 | Dalton | 4/149 |
| 2,554,106 | 5/1951 | Heubeck | 160/349 |
| 2,771,945 | 11/1956 | Wittrup | 160/124 |
| 2,778,030 | 1/1957 | Goche | 4/149 |
| 2,878,487 | 3/1959 | Foote | 4/154 |
| 2,923,013 | 2/1960 | Wasserman | 4/154 |
| 3,418,665 | 12/1968 | Long | 4/149 |
| 3,639,919 | 2/1972 | White | 4/149 |
| 3,879,806 | 4/1975 | Armstrong | 24/73 CH |
| 3,895,399 | 7/1975 | Giarrante | 4/149 |
| 3,934,636 | 1/1976 | Simmons | 160/349 R |
| 4,088,174 | 5/1978 | Edwards | 160/349 R |
| 4,117,557 | 10/1978 | McPeak et al. | 4/149 |
| 4,229,842 | 10/1980 | Gilmore | 4/610 |
| 4,361,915 | 12/1982 | Siewert | 4/608 |
| 4,381,578 | 5/1983 | Glejf | 16/94 |
| 4,385,409 | 5/1983 | File et al. | 4/608 |
| 4,461,056 | 7/1984 | Solinski | 16/87.4 R |
| 4,754,504 | 7/1988 | Cellini | 4/610 |
| 4,769,862 | 9/1988 | Skrzelowski | 4/610 |

*Primary Examiner*—Blair M. Johnson
*Attorney, Agent, or Firm*—Marvin C. Gaer

[57] ABSTRACT

A shower curtain corner support which can be slidably attached to a standard shower curtain rod in order to support and extend a shower curtain around the side corner of a shower stall or bathtub is disclosed. This apparatus is used to seal the shower area to prevent water and spray from escaping around the edges of a standard shower curtain. This shower curtain corner support, which is attached to a standard shower curtain rod near a side wall, consists of a short narrow beam directed into the shower area from which is suspended a shower curtain or curtain liner which will form an approximately right angle corner barrier about the open side corner of the shower area. A counterweight is attached to an outward beam of the corner support apparatus to maintain it in a parallel relation to the floor when the curtain is attached.

9 Claims, 8 Drawing Sheets

SHOWER CURTAIN SUPPORTS

FIELD OF THE INVENTION

The present invention is concerned with shower curtain supports to be used in combination with a standard shower curtain rod to support and extend a shower curtain around the open side corners of a shower stall or bathtub. These shower curtains are extended around these open corners to prevent shower spray from escaping the shower area. Shower spray tends to escape the shower area at the side edges of the standard shower curtains where the curtains meet the side walls of shower stalls or bathtub enclosures.

BACKGROUND OF THE DISCLOSURE

To prevent shower water and spray from escaping the area of a bathtub shower enclosure or shower stall, both often referred to below as a "shower stall" or as a "stall" for short, it is a common pratice to suspend a shower curtain downward from hooks that are slidably attached about a shower curtain support rod which bounds the outward opening of a stall from above. Shower areas are formed in various geometric configurations, for example, the three walls bounding three sides of a rectangular shower stall or bathtub, or the two walls forming a corner shower stall or bathtub.

A shortcoming of many shower curtain arrangements is that the curtain fails to produce a sufficiently tight barrier or seal against escaping water and water spray at the corners of the stall area where the edge of the curtain meets the stall walls at the ends of the standard supporting rods. Because of this failure to sufficiently seal the stall, water escapes the stall area wetting the surrounding floor and walls. This escaping water may cause damage or create unsafe slippery or unsanitary conditions. Removing this water by mopping it up or employing other means is inconvenient, time consuming and is not always completely successful. Various devices and attachments have been proposed for solving this problem with varying degrees of success. In many cases these devices and attachments tend to be both elaborate, complicated, expensive and/or hard to install thus tending to discourage their use. In some instances, in order to employ certain of these devices the replacement of the standard shower curtain rods is required adding to the expense and increasing the difficulty of installation.

SUMMARY OF THE INVENTION

To overcome these problems, this invention discloses simple, inexpensive showercurtain corner supports which will extend and support a shower curtain or curtain liner about the side edges of a stall area thus sealing the stall and preventing water and water spray from escaping the stall. These corner supports can be slidably attached to the standard shower curtain rods by means of an expanding snap-on clip arrangement.

In particular, this shower curtain corner support device will consist of a short bar beam which can be attached to the standard rod by an expanding snap-on clip. This beam will be oriented at an approximately right angle to the standard curtain rod and will extend into the stall area. The beam will have suspended from it a portion of a shower curtain. This curtain will bend around the side edge of the stall area forming a seal to prevent water or spray from escaping the stall at the edges when the corner support is slid to the wall. To the outward end of this beam will be attached another outer beam connected to a counterweight. This counterweight is provided to counterbalance the weight of the inner beam bar when the curtain is attached to the beam in order to hold the beam in a horizontal position and the corner curtains straight. This arrangement will thus form a corner curtain barrier or seal to the shower stall to prevent water and spray from escaping. It is expected that two such supplementary supports will be used, one at each end of the standard rod.

It is thus an object of this invention to provide a supplementary support means for suspending a shower curtain or curtain liner to prevent water from escaping around the edges of a shower stall.

It is a further object of this invention to provide a shower curtain support means which once installed will provide a stall corner seal which can be deployed with minimal intervention by the user.

It is a further object of this invention to provide a supplementary shower curtain support which is simple, inexpensive, easy to install and compatible with standard shower curtain support rods.

It is a further object of this invention to provide a supplementary shower curtain support which can be easily adapted to a variety of shower stall configurations.

These and other objects will be apparent to those skilled in the art.

BRIEF DESCRIPTION OF THE DRAWINGS

The more specific object features and advantages of this invention will be more readily apparent from the following description wherein reference is made to the accompanying drawings illustrating preferred embodiments of the invention.

In the drawings.

DETAILED DESCRIPTION OF THE DRAWINGS

Figure 1:
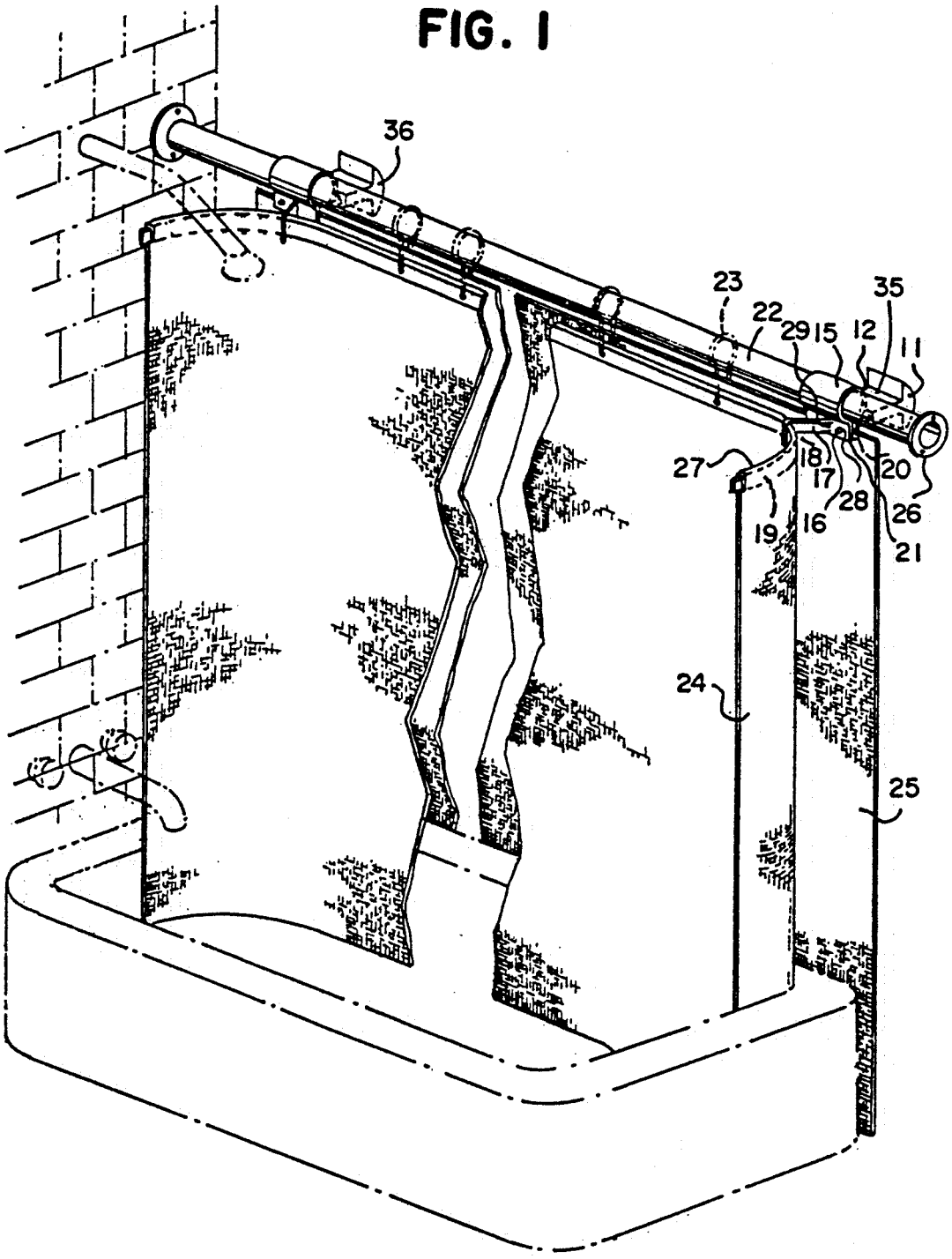
FIG. 1 is an upper perspective view from inside the shower stall area, showing a first version of two corner shower curtain supports, one at either end of a standard shower curtain rod, supporting a shower curtain liner around the open corners of a bathtub shower enclosure and a decorative shower curtain which hangs down on the outside of the bathtub.

FIGS. 1, 2, 3 and 4 are different views of a first version of this invention. Referring to FIG. 1, a standard shower curtain rod 22, attached above a bathtub or shower stall by screw collars 26 at either end of the rod, is illustrated. The shower rod 22 is shown attached to the left side wall. The right wall, to which it is also similarly attached, is not shown to simplify the drawing. The rod 22 is shown supporting an outer decorative shower curtain 25, an inner liner curtain 24, along with a shower curtain corner support apparatus, generally 35 and 36, at each of its ends. Since the corner shower curtain support 35, "corner support" for short, on the left side is the mirror image of that on the right side of the stall looking out, only the corner support 35 on the right side will be described in detail.

Figure 2:
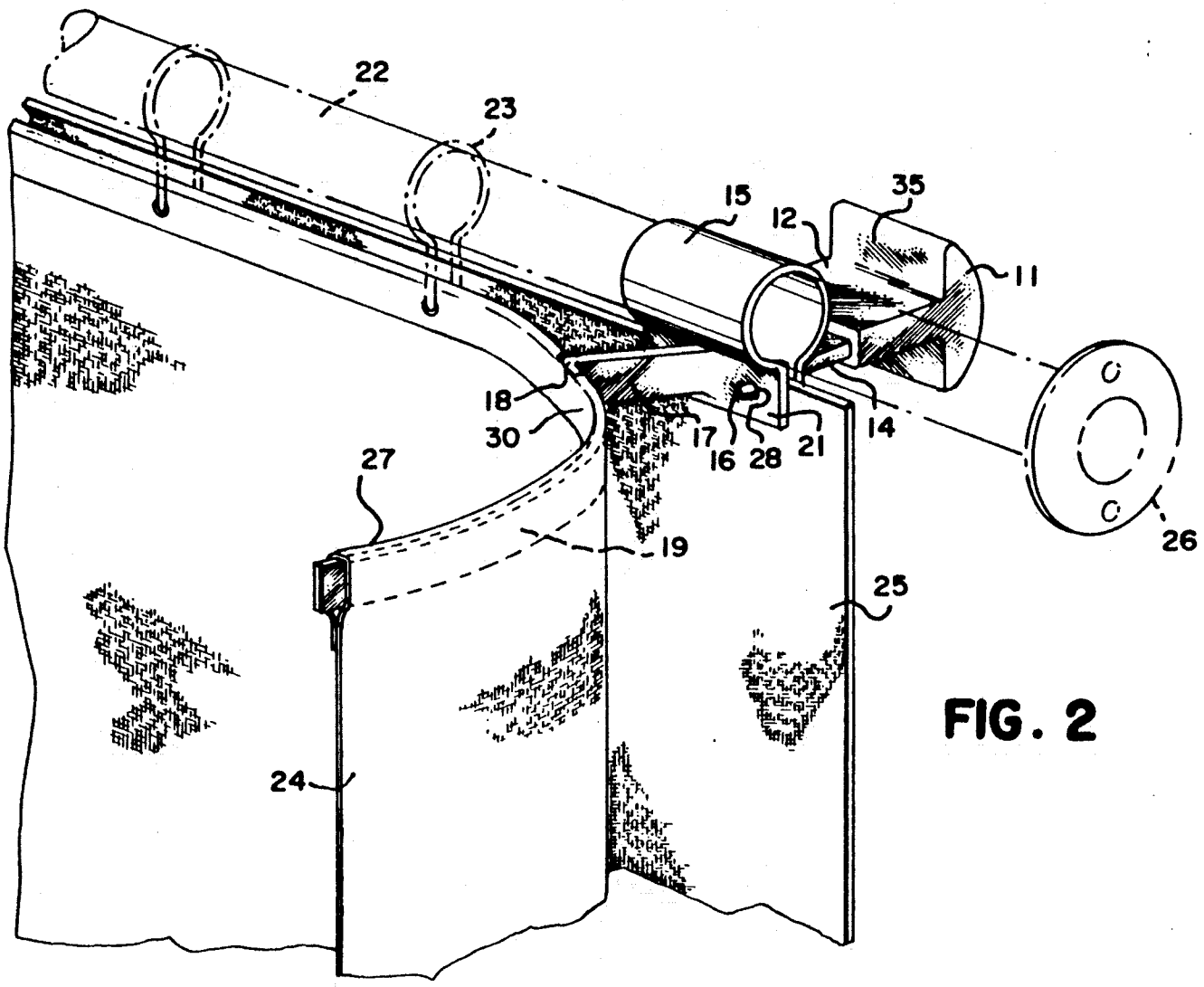
FIG. 2 is an enlarged upper perspective view of a first version of a corner shower curtain support holding up a shower curtain liner and a decorative outer shower curtain.

As shown in FIGS. 1 and 2, each corner support 35 is slidably attached to the rod 22, beyond the last curtain hook 23, by the cylindrical expansion sleeve 15 which clips around the rod 22, by spreading the downward directed parallel strips 20 and 21 over the rod 22.

Figure 3:
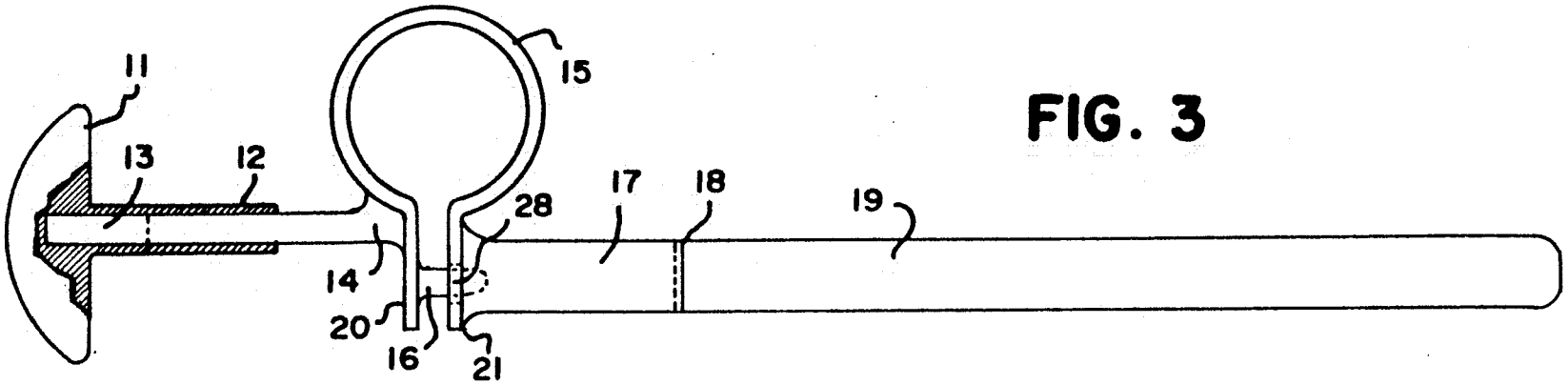
FIG. 3 is a side view of a first version of a corner shower curtain support.
Figure 4:
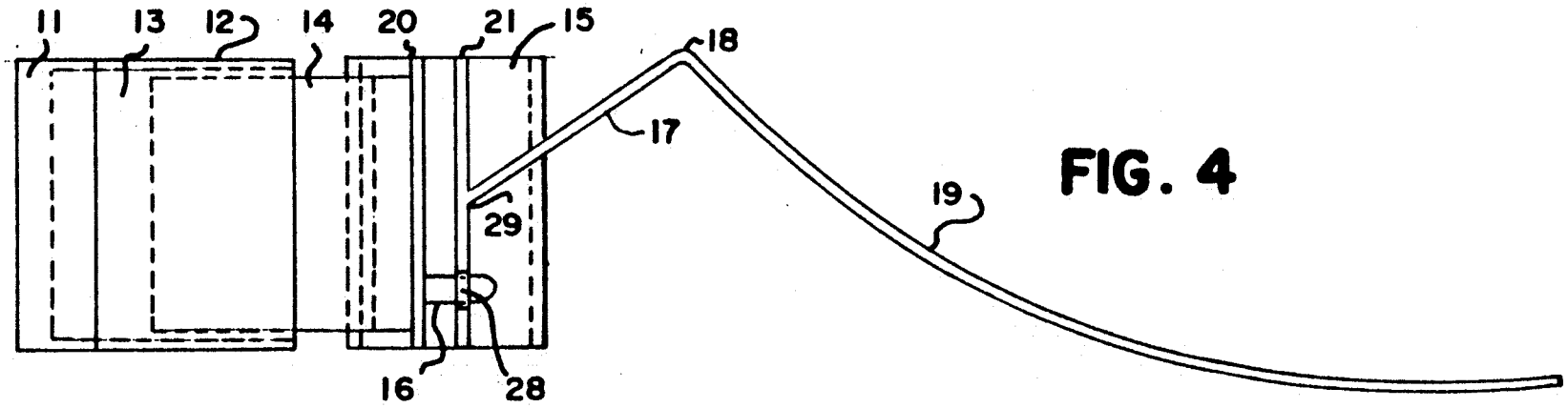
FIG. 4 is a bottom view of a first version of a corner shower curtain support.

Referring now also to FIGS. 3 and 4, a short inward directed peg 16 on the strip 20 is indicated which is mated to a matching opening 28 on the flat bar strip 21. This peg also serves to capture the last eyelet of the outer decorative shower curtain 25 after the corner support sleeve 15 is fitted over the rod 22. The peg 16 is to be inserted through the last eyelet on the curtain 25. Also the bar strip 21, at its vertical edge 29 away from the wall, is bent into a diagonal bar strip 17 at an approximately 45° angle to the curtain rod away from the side wall forming the corner edge 29 and a bar strip extension 17. The bar strip extension 17 runs approximately three inches in length to the corner edge 18 where it is formed into an approximately circular arc bar strip 19 of approximately twelve inches in length curving back toward the right side wall of the stall. The bar strips 17, 19, 20 and 21 are approximately one inch in their vertical dimension. The total bar strip formed by the combination of bar strips 17 and 19 is called the inner beam of the corner support 35.

The shower curtain liner 24 is to be provided along its top edge near each end with a narrow sleeve 27 approximately the same length as the bar strip 19, into which the bar strip 19 can be inserted through an opening 30 on the curtain liner sleeve 27. The shower curtain liner 24 will thus hang vertically on an inward directed curve following the bar strip 19 at each corner of the stall. Along the central portion of the rod 22, the shower curtain liner 24 will be suspended from the same hooks 23 as the outer decorative shower curtain 25.

On the outward facing side of the bar strip 20, at the intersection of the bar strip 20 and the cylindrical sleeve 15, a flat essentially square bar or plate 14, with sides of length slightly less than that of the cylindrical sleeve 15, will protrude with its flat side parallel to the floor when properly balanced. This plate 14 is the outer beam of the corner support 35. This plate 14 is provided to support the counterweight 11 by inserting the plate 14 into a channel 13 provided on a sleeve 12 of this counterweight 11. The counterweight 11 is to fit onto the plate 14 in a fairly snug but slideable relationship. The counterweight is provided to counterbalance the corner support apparatus 35 when the curtains are attached. By moving the counterweight inward or outward a sufficient distance on the plate 14, the curtains can be held perpendicular to the floor with the bar strip 19 held parallel to the floor.

When being used with the shower on, the corner supports 35 and 36 with curtains attached are pushed toward each end of the rod 22. The curved portions of the shower curtain liner 24 will then serve as a barrier to prevent shower spray from escaping around the outer edges of the stall. It should be noted that the cylindrical sleeve 15 will be of sufficient length to prevent horizontal twisting of the curtains about a vertical axis. When the shower is off, the corner supports 35 and 36 along with the curtains can be slid along the rod 22 away from the side walls to open the shower stall to allow a user to enter or exit the stall area. In many cases, the shower curtain liner 24 may prove to be so adequate a barrier to the shower spray escaping that the outer decorative curtain 25 will serve no useful purpose and could be dispensed with.

Figure 5:
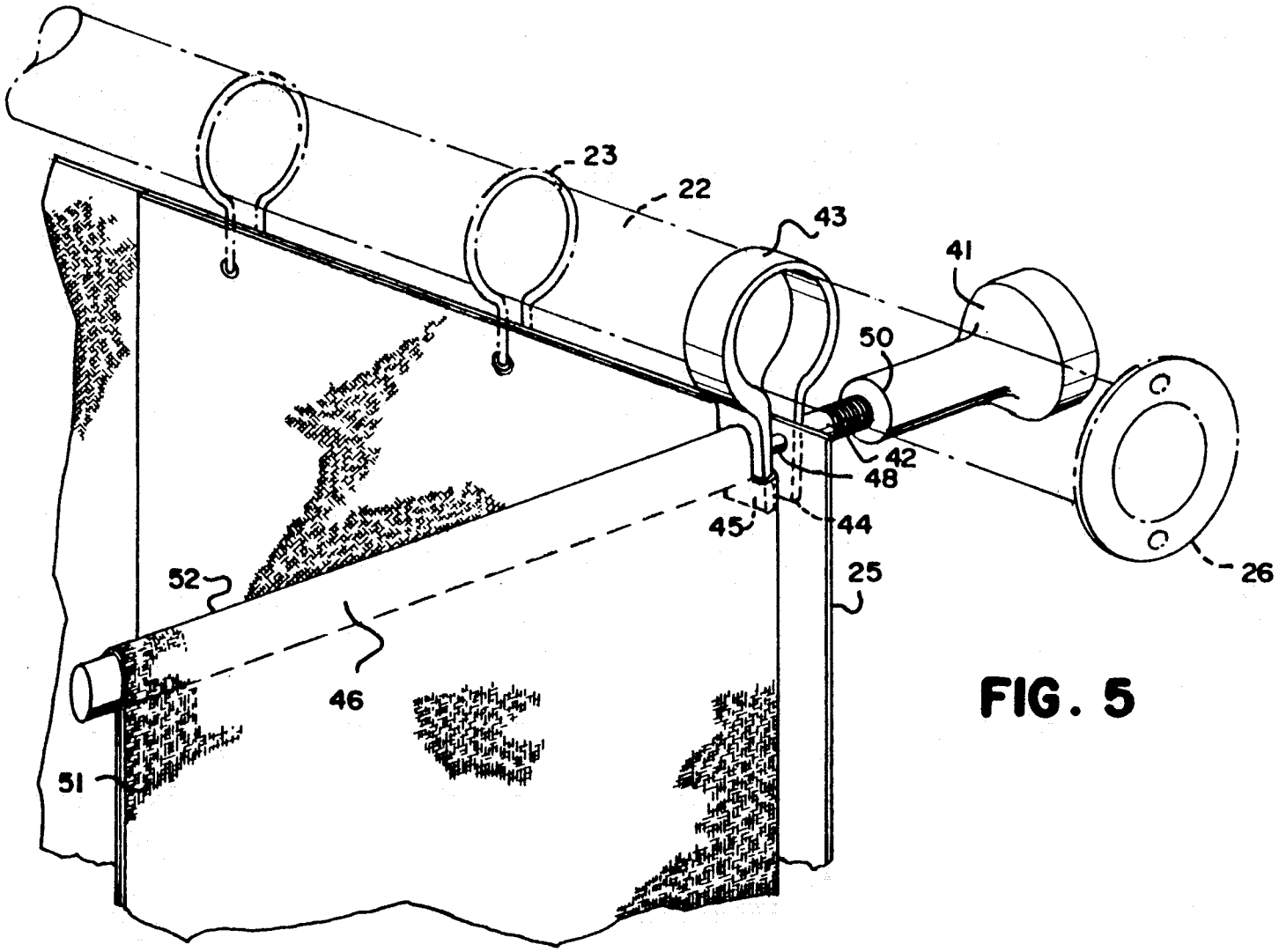
FIG. 5 is an upper perspective view of a second version of a corner shower curtain support suspended from a shower curtain rod, holding up a shower curtain and shower curtain liner and bending the shower curtain liner in a right angle into the stall at the right open corner of the stall area.

It should also be noted that if a decorative outer curtain 25 is used and the geometry of the stall allows the decorative curtain to hang inside the stall, then the complete inner liner curtains 24 could be replaced by two inner corner curtains. These inner corner curtains would only be placed at the corners of the stall. This type of arrangement is illustrated in FIG. 5 that accompanies the description of the second version below. In this case the outer curtain is necessary to provide a complete water barrier.

Figure 6:
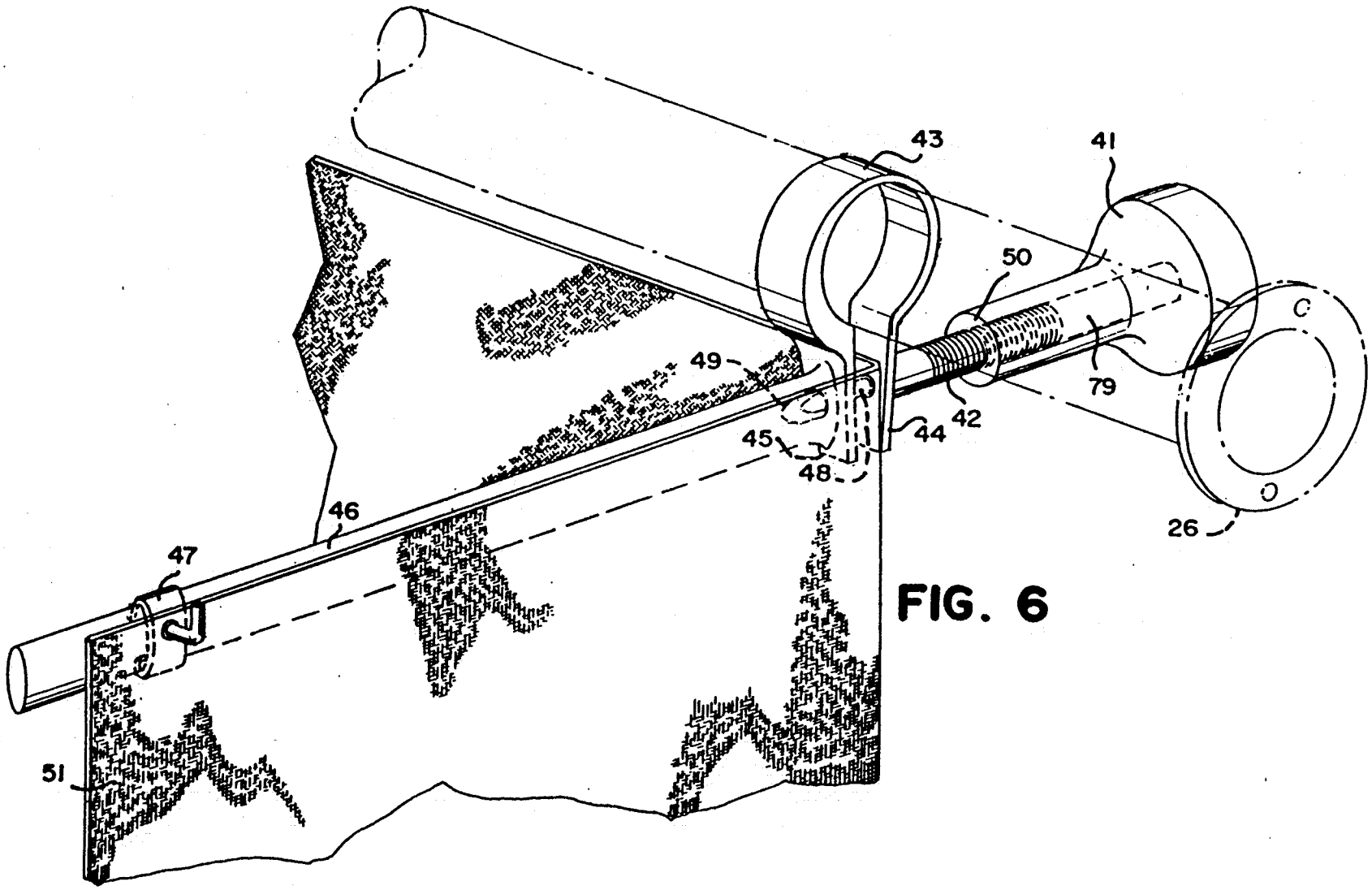
FIG. 6 is a more detailed side perspective view of a second version of the corner shower curtain support.

FIGS. 5 and 6 illustrate a second version of this invention. The corner support here labeled generally as 50 is shown attached to a standard shower curtain rod 22. The curtain rod 22 also supports, with curtain hooks 23, an outer decorative curtain 25, and an inner corner curtain liner 51. In this case the outer curtain 25 would have its lower edge inside the stall. As in the first version described above, a full shower curtain or curtain liner could be used instead of the corner curtain liners 51, in which case the outer decorative curtain could be dispensed with in most cases. Again, although only the right side of the shower curtain system is illustrated in FIG. 5, the system is usually expected to be used on both ends of the rod 22.

As indicated, the corner support 50 is slidably attached to the curtain rod 22 beyond the last curtain hook 23, by clipping the cylindrical expansion sleeve 43 around the rod 22. This is accomplished by spreading the downward opening jaws 44 and 45 about the rod 22. On the outer jaw 44 there is an inward directed peg 48 which is mated to a matching opening 49 on the inner jaw 45. This peg 48 passes through eyelets on the decorative curtain 25 and the corner curtain liner 51 serving as a curtain suspension attachment on the corner support 50.

Directed inward from the inner jaw 45 is a narrow oval shaped tube or bar 46, approximately one inch in height and approximately eight inches in length. This tube 46 is meant to support the inner curtain liner 51 by being inserted into a sleeve 52 provided therefor on the top edge of the inner curtain liner. This tube 46 is called the inner beam of the curtain support. An optional sliding hook adaptor 47 on the inner beam 46 may also be used for attaching the inner liner curtain 51 to the corner support 50. This optional adaptor hook 47 would attach to a last eyelet on the end of the inner liner curtain 51 and would be used instead of inserting the inner beam 46 into the sleeve 52. The tube 46 will usually be hollow to minimize the weight of the inner beam.

Extending outward from the outer jaw 44 is a threaded rod or bar 42 called the outer beam of the corner support 50. To this outer beam 42 is attached a counterweight 41. The counterweight 41 contains a threaded hollow channel 79 which allows the counterweight 41 to be screwed onto the outer beam. The counterweight 41 is screwed onto the outer beam 42 to a distance necessary to counterbalance the corner support 50 with the curtains attached, so as to hold the corner support 50 horizontal to the floor and keep the curtains vertically suspended.

When being used with the shower on, the corner supports 50 with the curtains attached are pushed to each end of the rod 22. The inner curtain liners will then extend around the outer corner edges of the stall forming an approximately right angle corner barrier to prevent shower water spray from escaping the stall area. When the shower is not in use, the corner supports 50 with the curtains attached can be slid toward the center of the rod 22 opening the stall area and allowing a user to enter or exit the stall.

Figure 7:
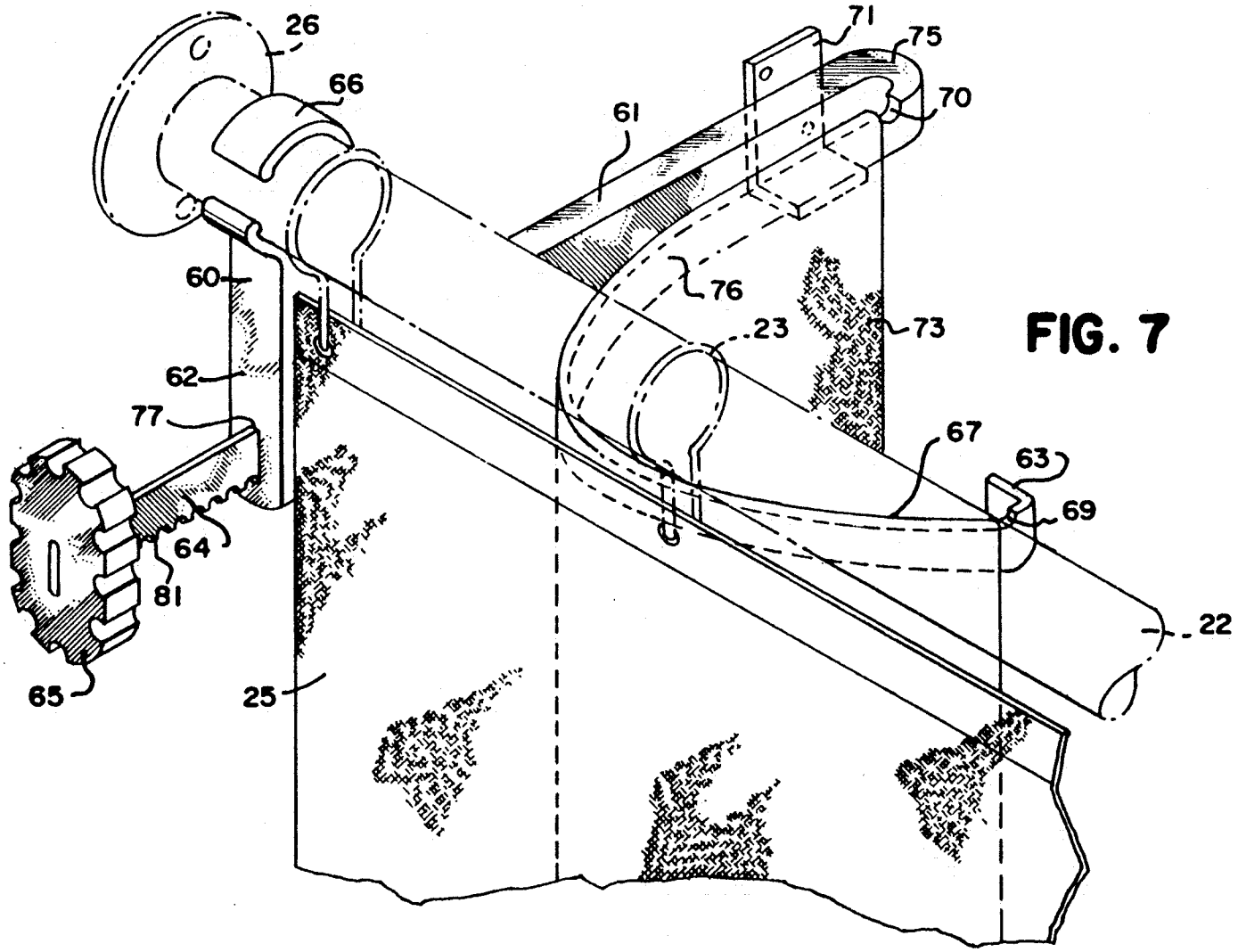
FIG. 7 is an upper perspective view of a third version of the corner shower curtain support with an outer shower curtain and an inner corner curtain.
Figure 8:
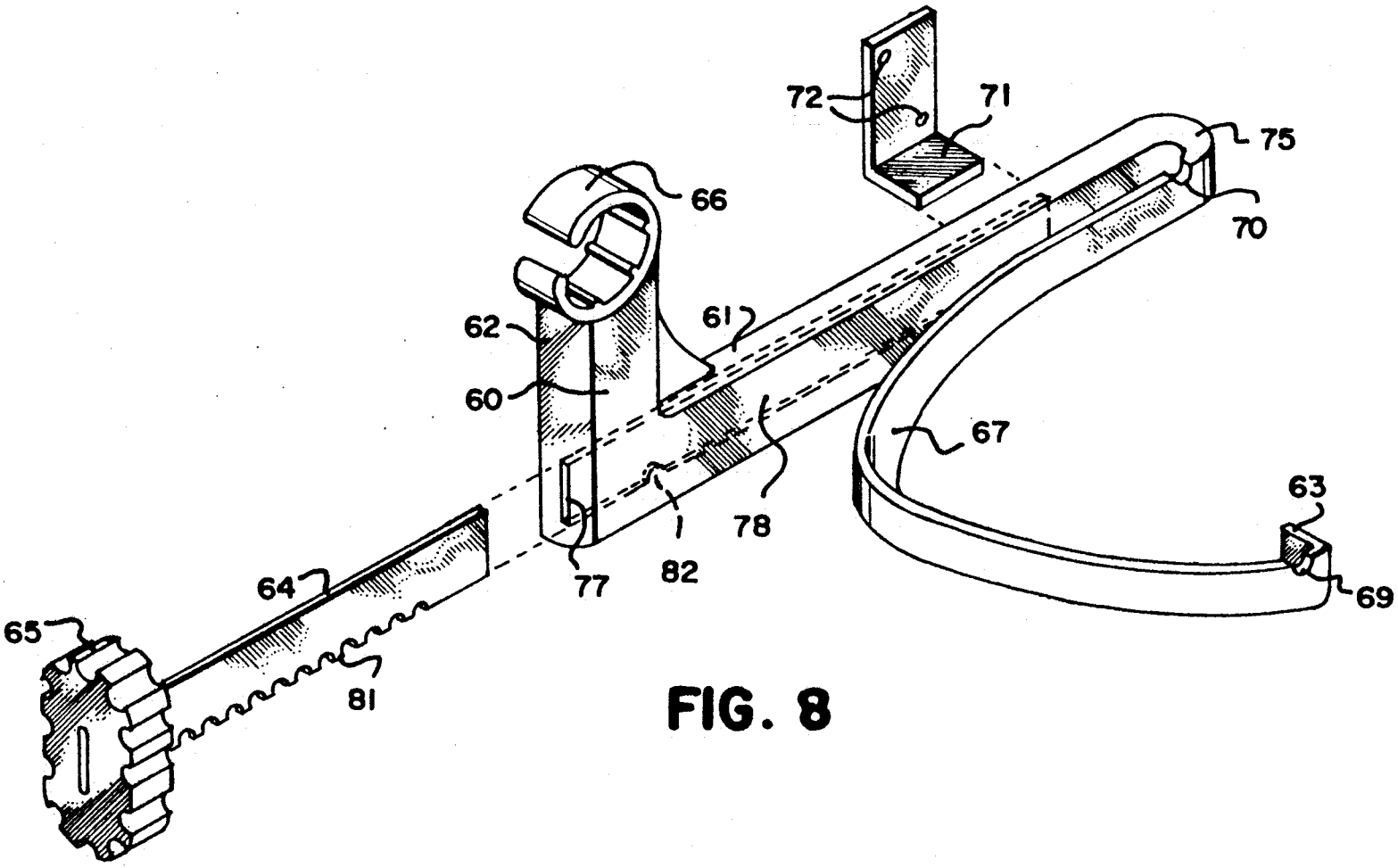
FIG. 8 is a detailed upper perspective exploded view of the third version of the corner shower curtain support.
Figure 9:
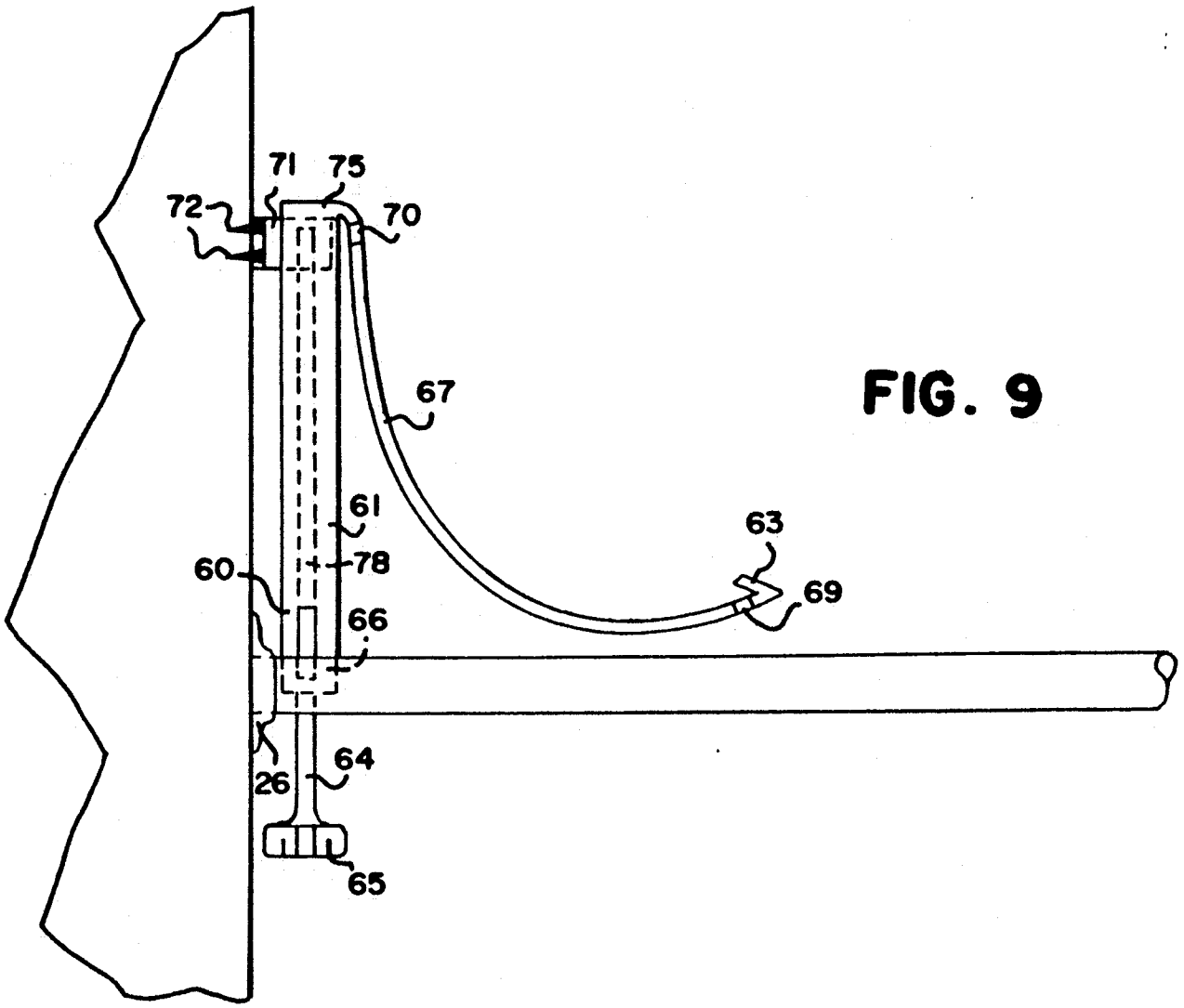
FIG. 9 is a top view of the third version of the corner shower curtain support.

Referring to FIGS. 7, 8 and 9, a third version of the corner support is described. In this version, a corner support, generally indicated as 60, is shown to be slidably attached to the standard support rod 22 at each of its ends by the snap fit sleeve 66, which clips around the rod 22. The rod 22 is attached to each side wall by the screw collars 26. Each corner support 60 supports a partial supplementary corner shower curtain 73 behind the standard outer shower curtain 25. This standard outer shower curtain 25 is suspended by the curtain hooks 23 from the rod 22 and slides back and forth on the rod 22 independently of the corner support 60. Because of this independent involvement of the outer curtain 25 to allow entrance and exit from the shower stall, the corner supports 60 along with the supplementary corner curtains 73 can remain stationary at the ends of the rod 22.

As indicated in FIGS. 7, 8 and 9, the main body of corner support 60 consists of the snap fit clip 66 which is extended approximately two inches above the inner beam bar 61 of the corner support 60 by a vertical stalk 62. The inner beam 61, about an inch in height, will extend about ten inches back into the shower stall area parallel to a side wall. At its back end 75, the inner beam 61 will be bent forward almost 180° to form a circular arc strip bar 67 of about 90° which is almost tangent to the main beam 61 at the bend 75. The arc strip 67, about one inch in height, will be about eighteen inches long and will extend forward almost to the rod 22, while curving about the open corner of the shower stall ending approximately parallel to the rod 22. The unattached end of the arc strip 67 will form a short acute angle bend 63 of about one inch in length; this is the curtain retainer. Also near either end, the arc strip 67 may also be provided with notches 69 and 70 on its upper edge. It is from this arc strip 67 that partial supplementary corner shower curtains 73 are to be suspended. The corner curtains 73 can be suspended by sliding the arc strip 67 through a sleeve 76 provided on the upper edge of these corner curtains 73. The corner curtains 73 will be prevented from sliding off the end of the arc strip 67 by the curtain retainer 63. If desired, the corner curtains can be suspended from the arc strip 67 by using four ordinary shower curtain hooks that can be passed through eyelets provided therefor on the corner curtains 73 as are provided on the front shower curtains 25. The hooks at each end would be captured in the notches 69 and 70 of the arc strip 67 to keep these corner curtains taut.

Along a portion of the length of the inner beam 61 there will be a hollow channel 78 opening forward through the channel aperture 77. Into this channel 78 through the channel aperture 77 can be inserted an outer beam bar 64 carrying a counterweight 65 at its front end. By inserting the outer beam 64 into the inner beam 61 to an appropriate distance, the corner support 60 can be held so that the inner beam 61 and arc strip 67 are parallel to the floor. This outer beam can be kept in place by serrations 81 on its lower edge which fit into a matching serration 82 in the channel 78.

Since this corner support 60 may also remain stationary at the end of the rod 22, an optional right angle bracket plate brace 71 about three inches in length can be provided which could be attached to the side wall by screws through the holes 72, the brace 71 forming a support to rest the back corner 75 of the inner beam 61. This support would be parallel to the shower floor and would hold the inner beam 61 parallel to shower stall floor since the inner beam 61 would tend to rotate downward at its back end. In this case, the counterweight 65 and outer beam 64 could be dispensed with. Thus, in operation, the corner support 60 would be held parallel to the floor with the supplementary corner curtains 73 curving about the corners of the shower stall to prevent water and spray from escaping the stall area. These supplementary curtains would be suspended slightly to the inside of the curtain rod 22, so as to allow the outer shower curtain 25 to slide back and forth on the rod 22 without interference. The top edge of these supplementary corner shower curtains 73 would also be below the top edge of the outer shower curtains 25, so that the supplementary curtains 73 would not be visible from outside the shower stall when the outer curtain 25 is drawn closed.

It is expected that in all three versions of this invention the curtain supports would be manufactured of a strong, somewhat flexible lightweight material such as plastic, metal or some combination of materials of this type.

It will be understood that the above description of the present invention is susceptible to various modifications, changes and adaptations, and the same are intended to be comprehended within the meaning and range of equivalents of the appended claims.

What I claim is:

1. A shower curtain corner support apparatus for supporting a portion of a shower curtain and extending it inward about an open corner of a shower stall area, said support apparatus having means for use in combination with a standard straight shower curtain support rod which extends across the open side of a shower stall, said support rod having a plurality of shower curtain hook means slidably mounted on it for supporting said shower curtain along its upper edge in a parallel slidable relation with said support rod, said support apparatus comprising a slidable sleeve attachment means for attaching said support apparatus in a slidable relation to said support rod, said sleeve attachment means joining an inner beam member and an outer beam member of said support apparatus, wherein said inner beam is a bar extending inward into said shower stall, said inner beam having means for attaching to and supporting an end portion of the upper edge of said shower curtain and bending it inwards into said shower stall at approximately a right angle to said support rod causing said shower curtain to hand downward in an approximately parallel relation to a side wall of said shower stall, and wherein said outer beam is a bar directed outward from said shower stall at approximately a right angle to said support rod, said outer beam further including attachment means for attaching a counterweight means to said outer beam at a sufficient distance away from said support rod for counterbalancing said inner beam and shower curtain and holding said upper edge of said end portion of said shower curtain in an approximately horizontal relation with said shower stall floor; and said support apparatus further comprising a counterweight means, said counterweight means comprising a counterweight means, said counterweight means having attachment means for attaching said counterweight means to said attachment means of said outer beam at a sufficient distance along said outer beam for counterbalancing said shower curtain support apparatus and shower curtain wherein said counterweight means has means for connecting it to said outer beam at varying distances along said outer beam in order to counterbalance said shower curtain support apparatus.

2. The shower curtain corner support apparatus of claim 1, wherein said slidable sleeve attachment means comprises a cylindrical sleeve opening at the bottom providing means for clipping said sleeve about said shower curtain support rod.

3. The shower curtain corner support apparatus of claim 1, wherein said inner beam comprises a bar strip generally curving in an outward arc toward said side wall of said shower stall and tangent to said side wall at its furthest unsupported end when said support apparatus is fully slid closed toward the end of said shower curtain rod.

4. The shower curtain corner support apparatus of claim 1, wherein said inner beam comprises a generally straight bar extending into said shower stall area at approximately a right angle to said shower curtain support rod.

5. The shower curtain corner support apparatus of claim 1, wherein said inner beam bar is sufficiently flat and narrow so as to fit into a sleeve along the upper edge of said shower curtain, in order to support said shower curtain.

6. The shower curtain corner support apparatus of claim 1, wherein said outer beam bar comprises a flat rectangular plate and said couterweight means includes a channel means for slidably attaching said counterweight means to said outer beam bar.

7. The shower curtain corner support apparatus of claim 1, wherein said outer beam bar comprises an externally threaded circular tube and said counterweight means includes a matching threaded circular channel means for mating to said outer beam bar by rotating it onto said outer beam at varying distances in order to counterbalance said support apparatus and shower curtain.

8. The shower curtain corner support apparatus of claim 1, wherein said inner beam extends into said shower stall area and is bent forward, at its inside end, into an approximately circular arc strip of about 90° which curves forward about a corner of said stall area, said circular arc strip being approximately tangent to said inner beam at the inside end of said inner beam and being approximately tangent to said shower curtain support rod at the forward end of said circular arc strip, said circular arc strip further having means for suspending said shower curtain therefrom.

9. The shower curtain corner support apparatus of claim 1, wherein said counterweight is fixably attached to said outer beam and said outer beam has means for attaching said outer beam and counterweight at varying distances along said outer beam in order to counterbalance said support apparatus and said shower curtain.

* * * * *